US007143967B2

(12) United States Patent
Heinrich et al.

(10) Patent No.: US 7,143,967 B2
(45) **Date of Patent: *Dec. 5, 2006**

(54) METHOD AND SYSTEM FOR COLD GAS SPRAYING

(75) Inventors: Peter Heinrich, Germering (DE); Thorsten Stoltenhoff, Wentorf (DE); Peter Richter, Heldenstein (DE); Heinrich Kreye, Hamburg (DE); Horst Richter, Norwich, VT (US)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/721,747

(22) Filed: Nov. 26, 2003

(65) Prior Publication Data

US 2004/0166247 A1 Aug. 26, 2004

Related U.S. Application Data

(63) Continuation of application No. PCT/EP02/04978, filed on May 6, 2002.

(30) Foreign Application Priority Data

May 29, 2001 (DE) ..... 101 26 100

(51) Int. Cl.
*B05B 1/00* (2006.01)
*B24C 5/04* (2006.01)

(52) U.S. Cl. ..... 239/597; 239/594; 239/434.5; 239/423; 451/102; 427/192

(58) Field of Classification Search ..... 239/597, 239/594, 434.5, 423; 451/102; 118/308; 427/192

See application file for complete search history.

(56) References Cited

U.S. PATENT DOCUMENTS

| | | | | |
|---|---|---|---|---|
| 4,004,735 | A * | 1/1977 | Zverev et al. | 239/79 |
| 4,506,834 | A * | 3/1985 | Ek | 241/1 |
| 4,669,658 | A * | 6/1987 | Nevgod et al. | 239/81 |
| 5,445,325 | A * | 8/1995 | White | 239/132.5 |
| 5,531,590 | A * | 7/1996 | Browning | 431/8 |
| 6,139,913 | A * | 10/2000 | Van Steenkiste et al. | 427/191 |
| 6,972,138 | B1 * | 12/2005 | Heinrich et al. | 427/446 |

FOREIGN PATENT DOCUMENTS

| | | |
|---|---|---|
| EP | 484533 B1 * | 5/1990 |
| WO | WO 98/22639 * | 10/1997 |

* cited by examiner

*Primary Examiner*—Dinh Q. Nguyen
(74) *Attorney, Agent, or Firm*—Crowell & Moring LLP

(57) ABSTRACT

A cold gas spraying method and device, whereby the sprayed particles are accelerated in a gas flow. A powder tube and an outer nozzle body together form a Laval nozzle that produces high gas flow velocities. The injection of the sprayed particles occurs in the divergent section of the Laval nozzle.

8 Claims, 2 Drawing Sheets

METHOD AND SYSTEM FOR COLD GAS SPRAYING

CROSS REFERENCE TO RELATED APPLICATIONS

This application is a continuation of international patent application no. PCT/EP02/04978, filed May 6, 2002, designating the United States of America, and published in German as WO 03/041868, the entire disclosure of which is incorporated herein by reference. Priority is claimed based on Federal Republic of Germany patent application no. DE 101 26 100.4, filed May 29, 2001.

BACKGROUND AND SUMMARY OF THE INVENTION

The invention relates to a method and a system for producing a coating or a structural part by means of cold gas spraying, during which powdery spraying particles are injected by means of a powder tube into a gas jet for which a gas is brought to a output pressure of up to 6.3 MPa and is expanded by way of a Laval nozzle. When the gas jet is expanded in the Laval nozzle, the spraying particles are accelerated to speeds of up to 2,000 m/sec.

It is conventional to apply coatings by means of thermal spraying to many different types of materials. Conventional methods used for this purpose are, for example, flame spraying, arc spraying, plasma spraying or high-speed flame spraying. More recently, a method—the so-called cold gas spraying method—was developed by which spraying particles are accelerated to high speeds in a "cold" gas jet. The coating is formed by impacting particles with a high kinetic energy on the workpiece. The particles, which do not melt in the "cold" gas jet, form a dense and firmly adhering layer at impact, the plastic deformation and the resulting local heat release providing the cohesion and adhesion of the sprayed layer on the workpiece. A heating-up of the gas jet warms the particles for better plastic deformation during the impact and increases the flow rate of the gas and thus also the particle speed. The related gas temperature may amount to up to 800° C. but is clearly below the melting temperature of the coating material, so that melting of the particles does not take place in the gas flow. An oxidation and/or phase transitions of the coating material can therefore largely be avoided. The spraying particles are added as a powder that typically at least partially comprises particles of a size from 1 to 50 μm. The spraying particles obtain their high kinetic energy during the gas expansion. After the injection of the spraying particles into the gas jet, the gas is expanded in a nozzle, the gas and the nozzle being accelerated to speeds above the speed of sound. Such a method and a system for cold gas spraying are described in detail in European Patent Document EP 0 484 533 B1. In this case, a de Laval nozzle, in the following abbreviated Laval nozzle, is used as the nozzle. Laval nozzles consist of a convergent section and of a divergent section adjoining the latter in the flow direction. In the divergent area, the contour of the nozzle must be shaped in a defined manner in order to avoid flow separations and compression shocks and to ensure that the gas flow observes the laws according to de Laval. Laval nozzles are characterized by this contour and the length of the divergent section and furthermore by the ratio of the outlet cross-section to the narrowest cross-section. The narrowest cross-section of the Laval nozzle is called the nozzle neck. Hydrogen, helium, argon, air or mixtures thereof are used as the process gas. However, nitrogen is used in most cases. Higher particle speeds are reached by means of helium or helium/nitrogen mixtures.

Currently, systems for cold gas spraying are designed for pressures from approximately 1 MPa to a maximal pressure of 3.5 MPa and for gas temperatures to approximately 800° C. The heated gas, together with the spraying particles, is expanded in a Laval nozzle. While the pressure decreases in the Laval nozzle, the gas flow rate rises to values of up to 3,000 m/s, and the particle speed increases to values of up to 2,000 m/s. As known, the spraying particles are injected into the Laval nozzle by means of a powder tube—viewed in the flow and spraying direction—in front of (or upstream from) the nozzle neck in the inlet area of the Laval nozzle. A pressure condition exists there which is close to the output pressure; pressures of up to 3.5 MPa are therefore possible. At least such a pressure has to be applied during the injection of the powdery coating material. However, at such high pressures, the conception and the operation of a powder conveyer present considerable problems which have not been satisfactorily solved technically. Disturbing turbulences of the spraying particles at the end of the powder tube, by means of which the particles are injected into the Laval nozzle, are also disadvantageous. These turbulences hinder the acceleration and reduce the quality. In addition, the production of a Laval nozzle, in which the high gas and particle flow rates are achieved, requires high expenditures and costs, because of its smallest, narrowest cross-section of a diameter of only 1.5 to 3.5 mm.

International Patent Document WO 98/22639 and U.S. Patent Document 2002/0071906 contain systems for cold gas spraying which are characterized in that the feeding of the spraying particles takes place laterally in the divergent section of the Laval nozzle. For this purpose, an opening is provided in the divergent section of the Laval nozzle, which opening is lockingly connected with the powder tube.

It is therefore an object of the present invention to provide a method and a system of the initially mentioned type which carries out the injection of the spraying particles while avoiding the above-mentioned disadvantages.

This and other objects and advantages are achieved by the injection of the spraying particles axially and centrically within the Laval nozzle and not before the divergent section of the Laval nozzle. In an embodiment, the invention comprises expanding a gas jet using a Laval nozzle, injecting powdery spraying particles into the gas jet, and accelerating the spraying particles to a speed of up to 2000 m/s. The spraying particles are injected into the gas jet axially and centrically. Additionally, the spraying particles are injected at a location in the gas jet that is downstream in the spraying direction from a nozzle neck of the Laval nozzle.

The displacing of the injection point into an area where the nozzle widens again means that the injection takes place at a pressure which is clearly below the maximal output pressure because the expansion of the gas already starts in this area. The considerable pressure drop, which starts in the area of the nozzle neck, even permits the increasing of the gas inlet pressure to up to 6.3 MPa. Because of the pressure drop, the injection of the powdery spraying particles is significantly facilitated, allowing for the use of conventional injection methods. Particularly, the conception and the operation of the powder conveyer are simplified and current powder conveyers, which normally operate in a range of up to 1.5 MPa, can be used. Since not only the pressure drops in the divergent part of the Laval nozzle but also the temperature of the gas, the gas can be preheated to higher temperatures. As a result, the flow rate of the gas can be increased. However, the spraying particles first come in contact with the "cold" gas. This prevents a baking of the particles onto the nozzle wall, which occurs at higher gas inlet temperatures.

In another embodiment of the invention, the combination of the shapes of the outer contour of the powder tube together with the inner contour of the outer tube results in a nozzle which corresponds to the interrelationships of de Laval. In this case, the powder tube is advantageously mounted axially and centrically in the outer nozzle body. By means of this Laval nozzle, the cold gas spraying method can be implemented in an advantageous manner. The preheated gas is accelerated to flow rates of up to 3000 m/s. High gas flow rates are a prerequisite for high particle speeds. The contact of the particles with the gas takes place at high flow rates and at temperatures at which the spraying particles are only warmed up. As a result, the warmed-up spraying particles are optimally accelerated before they impact on the workpiece. In an embodiment, the particles are accelerated to at least 100 m/s, preferably at least 350 m/s, and more preferably at least 500 m/s.

In still another embodiment, the injection of the spraying particles takes place at a location which is situated in the area between a quarter of a distance and half a distance whose starting point is defined by the nozzle neck and whose end point is defined by the nozzle outlet, the measuring taking place from the direction of the nozzle neck.

The injection site for the spraying particles is advantageously selected such that the injection of the spraying particles takes place in the divergent section of the Laval nozzle at a pressure of less than two thirds of the output pressure. This ensures that simple spraying particle injection methods and current powder conveyers can be used. Even injection of spraying particles at pressures which are below the normal pressure can be achieved. This means that no pressure has to be applied for the injection because the spraying particles are pulled into the gas jet. On the other hand, the inlet pressure for the gas can be selected to be clearly higher than in the case of cold gas spraying methods customary today. A high gas inlet pressure which, in the case of the method according to the invention, may amount to up to 6.3 MPa, preferably between 1.0 and 3.5 MPa, results in high gas flow rates and thus permits high speeds for the spraying particles.

In a preferred embodiment, the gas passage has a circular-ring-shaped (annular) cross-section at the narrowest point. This cross-section is bounded on the inside by the outer contour of the powder tube and is bounded on the outside by the inner contour of the nozzle tube. The gas is accelerated in this gas passage. The size of the gas passage also defines the gas consumption during the cold gas spraying. Since, without creating any problem, the circular-ring-shaped cross-section can be selected to be small, the method suggested here can be applied in an economical manner.

The cold gas spraying system according to the invention is characterized in that the powder tube ends axially and centrically in the divergent section within the Laval nozzle. The powder tube therefore ends in an area in which the pressure already has already dropped as a result of the gas acceleration. The construction of the powder conveyer will thereby be considerably simplified because the latter only has to be dimensioned for the lower pressure which exists at the end of the powder tube. Because of the insertion of the powder tube into an outer nozzle body, according to the invention, the Laval nozzle now consists of two parts which are easy to manufacture. The outer nozzle body, whose inner side has to be machined, is relatively large, and the powder tube, which forms the second part of the Laval nozzle, has to be machined only on the outer side. The Laval nozzle required according to the invention is therefore clearly easier to manufacture than the nozzles used so far because particularly the manufacturing of the inner contour of a nozzle presents problems if this contour is very narrow. This is a great advantage because, during the cold gas spraying, the nozzle is subjected to considerable wear and therefore has to be exchanged at regular intervals. The gas consumption of the cold gas spraying system according to the invention is not increased by the larger cross-section of the Laval nozzle because this cross-section is defined by way of the narrowest distance between the outer edge of the powder tube and the inner contour of the outer nozzle body. This is beneficial because the gas consumption, which is already very high for the methods corresponding to the state of the art, should not be increased further in order to be able to implement the method suggested here in an economical manner. Quality-reducing turbulences of the spraying particles, which occur at the outlet site, are also prevented by such a design of the Laval nozzle consisting of the powder tube and the outer nozzle body.

In a further embodiment of the invention, the inner shape of an outer nozzle body together with the outer shape of a powder tube arranged coaxially in the outer nozzle body and oriented in the spraying direction result in a Laval nozzle. The powder tube is advantageously arranged axially and centrically in the outer nozzle body. A Laval nozzle designed in this manner—in comparison to the nozzles used according to the state of the art—can be produced without any problems because, as a result of the construction according to the invention, the inner contour of the outer nozzle body and/or the outer side of the powder tube can be manufactured. In comparison, this is not problematic because the outer nozzle body is large in comparison and can therefore be manufactured relatively easily and, in the case of the small powder tube, only the outer surface, which is easy to machine, is to be machined and not the inner contour.

In yet another embodiment, the cold gas spraying device is designed such that the ring-shaped area for the gas passage, which is defined by the distance between the outer contour of the powder tube and the inner contour of the outer nozzle body, at its smallest point, has a size of from 1 to 30 $mm^2$, preferably from 3 to 10 $mm^2$. As a result of this characteristic, it is ensured that the gas consumption, which is defined by this ring-shaped area, is comparable to the gas consumption of a cold gas spraying system according to the state of the art, and the remaining function also takes place in a favorable manner. This is beneficial for ensuring the economic efficiency of the system.

Other configurations can be used to create the Laval nozzle from the powder tube and the outer nozzle body. For example, the powder tube situated on the inside may have a contour on its outer side which is designed such that, together with a smooth cylindrical inner contour of the outer nozzle body, a Laval nozzle is formed.

Alternatively, a Laval nozzle can be obtained which consists of a powder tube, which is situated on in the interior and has a smooth cylindrical outer side, and a nozzle body which is situated outside and is correspondingly shaped on its inner side.

As another possibility, the required contour for the Laval nozzle can be formed partially by the outer side of the power tube and partially by the inner side of the outer nozzle body.

In an advantageous embodiment, the opening ratio of the Laval nozzle, that is, the ratio of the cross-sectional area for the gas passage at the narrowest point to the cross-section at the outlet of the nozzle, is between 1:2 and 1:25, preferably between 1:5 and 1:11.

In a preferred variant, the outer nozzle body has a circular-ring-shaped cross-section in the convergent area, which cross-section changes in the divergent area of the nozzle into a rectangular cross-section. By means of rectangular shapes, narrow areas and large surfaces are coated in an advantageous manner.

Advantageously, the powder tube as well as the outer nozzle body each consist of a metallic material, a ceramic material or a plastic material.

In an embodiment, the powder tube and the nozzle body consist of different materials. Different metal alloys, different ceramic materials, different plastic materials, or a combination thereof, for example, metal/ceramics, metal-plastics, plastics/ceramics, can be used for this purpose. The outer nozzle body preferably consists of metal, while the powder tube situated on the inside is made of ceramics.

In an advantageous variant, the powder tube and/or the outer nozzle body—viewed in the flow direction—are joined together of two or more parts, the first part comprising the area around the nozzle neck, which is adjoined by a second part reaching to the nozzle outlet. In this case, the second part can easily be exchanged and, with respect to its shape and material, is selected according to the requirements of the different spraying materials.

The two above-mentioned parts advantageously consist of different materials.

In the following, the invention will be described in detail by means of two schematically illustrated examples:

DETAILED DESCRIPTION OF THE EMBODIMENTS

Figure 1:
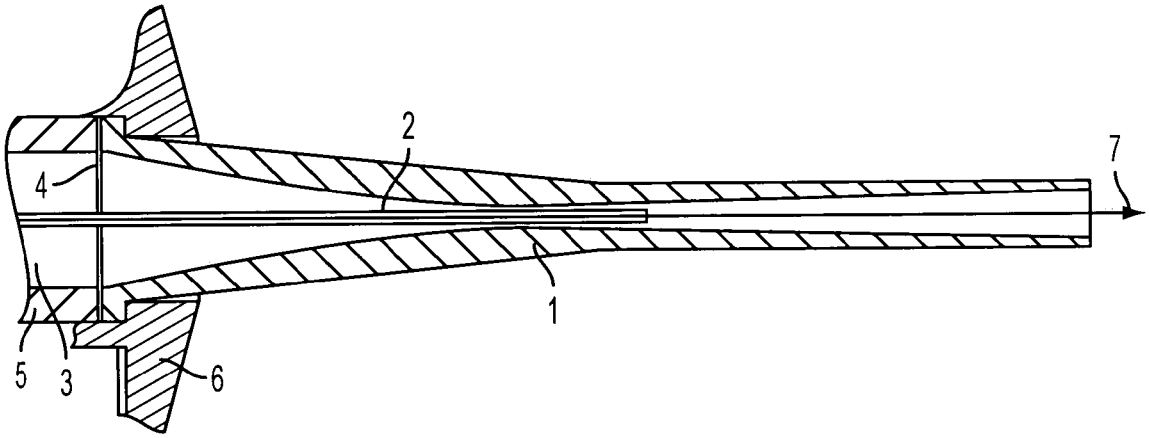
FIG. 1 is a view of a cold gas spraying system according to the invention in whose construction the powder tube ends in the divergent area of the outer nozzle body.

The cold gas spraying system schematically illustrated in FIG. 1 comprises a cylindrical housing 5 with an antechamber 3 situated on the inside and closed off on the output side by a gas distribution screen 4 which, in turn, is penetrated in the center by a powder (feeding) tube 2. The gas distribution screen 4 is adjoined by an outer nozzle body 1, the screen 4 and the nozzle 1 being fastened to the housing 5 by means of a union nut 6. The spraying direction of the illustrated system is indicated by an arrow 7. The powder tube 2 is axially and centrically arranged in the outer nozzle body 1. The powder tube 2, which follows the center axis of the outer nozzle body 1 and is held by the screen 4, ends, coming from the housing, behind the narrowest point in the divergent area of the outer nozzle body 1, where the gas pressure has already dropped considerably in comparison to the initial pressure and normally amounts to only half of the latter. The high initial pressure exists in the antechamber and, in applications customary today, frequently amounts to between 1 and 3.5 MPa and can be increased to up to 6.3 MPa as a result of the further development of the cold gas spraying system according to the invention.

Figure 2A:
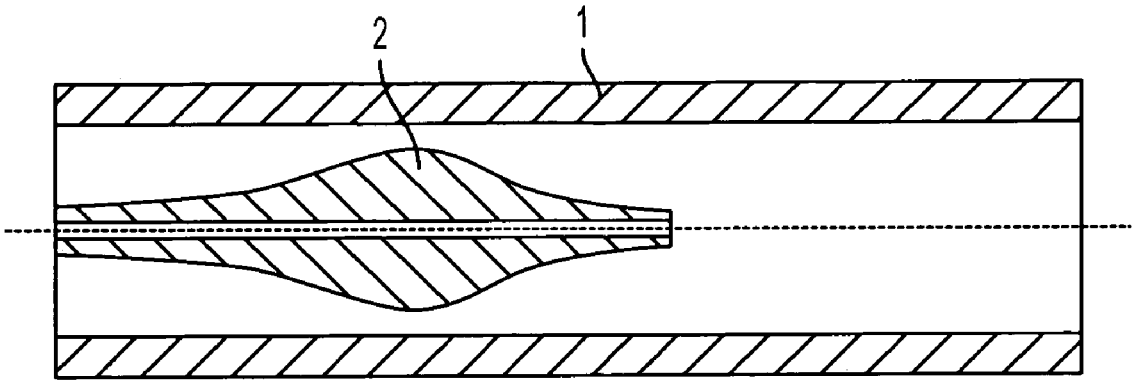
FIG. 2 is a view of three variants of the further development of the Laval nozzle consisting of the powder tube and the outer nozzle body.
Figure 2B:
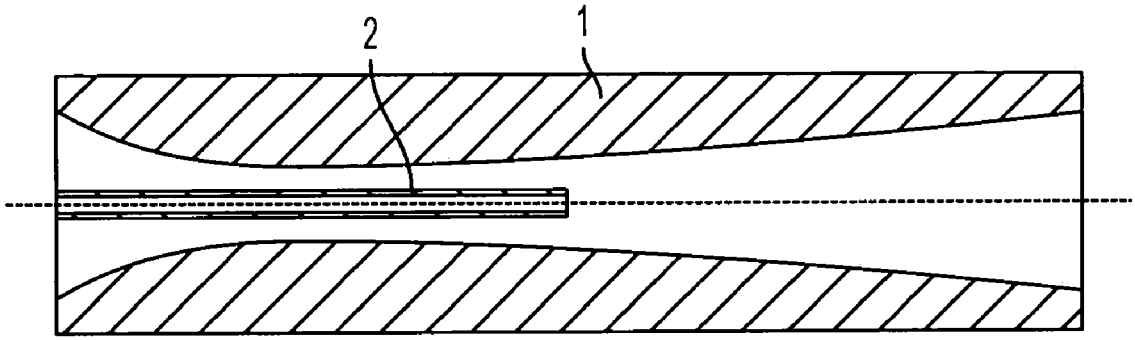
Figure 2C:
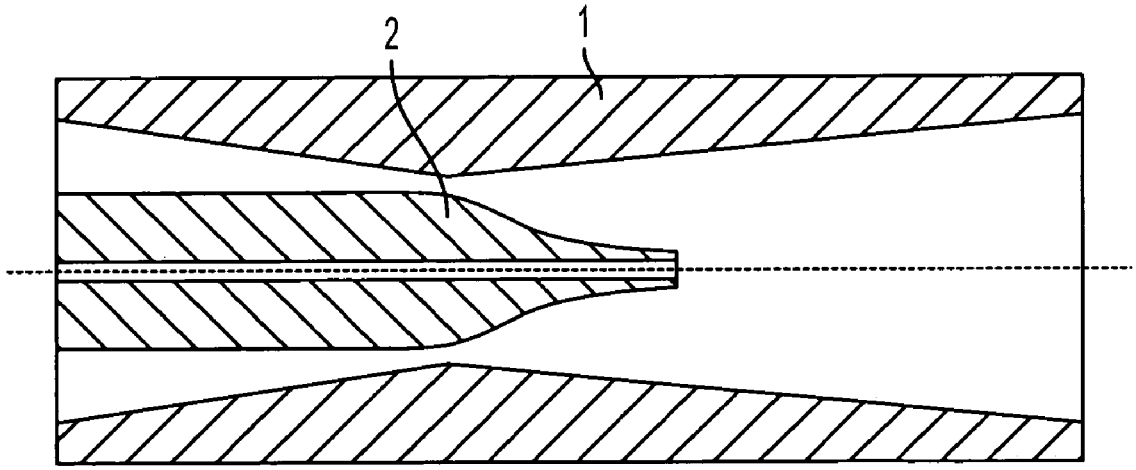

FIG. 2 shows three particularly advantageous further developments of a cold gas spraying system according to the invention, particular reference being made to the design of the powder tube 2 and of the outer nozzle body (reference numbers as in FIG. 1). In FIGS. 2*a, b* and *c*, the powder tube 2 is in each case surrounded by the outer nozzle body 1. The combination of the inner contour of the outer nozzle body and of the outer form of the powder tube result in a Laval nozzle. In FIG. 2*a*, a smooth cylindrical inner shape of the outer nozzle body, together with an outward-curved outer contour of the power tube results in the Laval nozzle. In contrast, in FIG. 2*b*, the powder tube has a cylindrical shape, and the outer nozzle body is curved in its inner side. In FIG. 2*c*, the nozzle body and the powder tube are curved in such a manner that the combination of shapes of the outer side of the powder tube and of the inner side of the outer nozzle body is obtained which is necessary for the Laval nozzle.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A cold gas spraying system having a Laval nozzle comprising an outer nozzle body and a powder tube capable of feeding spraying particles into the outer nozzle body, wherein the powder tube ends in a divergent section of the Laval nozzle and is aligned axially and centrically with the outer nozzle body, and the Laval Nozzle is formed by an inner shape of the outer nozzle body together with an outer shape of the powder tube arranged coaxially in the outer nozzle body and oriented in the spraying direction.

2. A cold gas spraying system according to claim 1, wherein an annular area for passage of a gas flow, which is defined as an area between an outer contour of the powder tube and an inner contour of the outer nozzle, has a size of between about 1 to 30 $mm^2$ at a nozzle neck.

3. A cold gas spraying system according to claim 2, wherein the size of the annular area at the nozzle neck is between about3to10$mm^2$.

4. A cold gas spraying system according to claim 1, wherein a contour of an outer side of the powder tube together with a smooth cylindrical contour of the outer nozzle body form the Laval nozzle.

5. A cold gas spraying system according to claim 1, wherein the powder tube has a smooth cylindrical outer side and the nozzle body is shaped on its inner side such that the Laval nozzle is formed.

6. Cold gas spraying system according to claim 1, wherein the contour necessary for formation of the Laval nozzle is partially provided by an outer side of the powder tube and partially by an inner side of the outer nozzle body.

7. Cold gas spraying system according to claim 1, wherein the opening ratio of the Laval nozzle, defined by the ratio of the cross-sectional area for the gas passage at the narrowest point to the cross-section at the outlet of the nozzle, is between 1:2and 1:25.

8. A cold gas spraying system according to claim 7, wherein the opening ratio of the Laval nozzle is between 1:5 and 1:11.

* * * * *